United States Patent [19]

Seto et al.

[11] Patent Number: 4,559,185

[45] Date of Patent: Dec. 17, 1985

[54] VARIABLE VENTURI TYPE CARBURETOR

[75] Inventors: Toshiaki Seto; Hideo Yamamoto; Yoshiji Kobayashi, all of Odawara, Japan

[73] Assignee: Mikuni Kogyo Kabushiki Kaisha, Tokyo, Japan

[21] Appl. No.: 675,444

[22] Filed: Nov. 27, 1984

[51] Int. Cl.[4] ..... F02M 9/02

[52] U.S. Cl. ..... 261/41 D; 261/44 C; 261/121 B; 261/DIG. 39; 261/DIG. 56

[58] Field of Search ..... 261/41 D, DIG. 56, 121 B, 261/41 R, 44 C, DIG. 39

[56] References Cited

U.S. PATENT DOCUMENTS

| | | | |
|---|---|---|---|
| 2,711,884 | 6/1955 | Zamack | 261/DIG. 56 |
| 3,037,752 | 6/1962 | Gretz | 261/41 R |
| 3,680,846 | 8/1972 | Bickhaus et al. | 261/DIG. 56 |
| 3,715,108 | 2/1973 | Denton | 261/DIG. 56 |
| 3,778,041 | 12/1973 | Kincade | 261/DIG. 56 |
| 3,985,838 | 10/1976 | Marsee | 261/44 C |
| 4,118,444 | 10/1978 | Abbey | 261/DIG. 56 |
| 4,187,805 | 2/1980 | Abbey | 261/DIG. 56 |

FOREIGN PATENT DOCUMENTS

| | | | |
|---|---|---|---|
| 47-1140 | 1/1972 | Japan | 261/DIG. 56 |
| 58-150062 | 6/1983 | Japan | 261/41 R |

*Primary Examiner*—Tim Miles
*Attorney, Agent, or Firm*—Pahl, Lorusso & Loud

[57] ABSTRACT

A variable venturi type carburetor including both inner and outer venturis, a main nozzle for injecting main fuel into the inner venturi and a piston valve displaceably mounted on the outer venturi to move under the influence of negative pressure transmitted from the intake passage. The carburetor further includes an auxiliary fuel nozzle for feeding auxiliary fuel to the outer venturi in response to movement of the piston valve. The auxiliary fuel nozzle is disposed on the outer venturi adjacent to the main nozzle and the center axes of both the nozzles are located on the same or substantially same plane extending in the direction of the intake passage. A bleed air valve is mounted midway of the atmospheric pressure introduction passage which is branched from the auxiliary fuel passage so as to open the passage when higher negative pressure is transmitted from manifold. Further, a vacuum switching valve is mounted midway of the atmospheric pressure introduction passage extending from the negative pressure chamber on the valve piston so as to open the passage when higher negative pressure is transmitted from manifold. One end of each of the atmospheric pressure introduction passages for both the valves is opened to the atmosphere.

11 Claims, 6 Drawing Figures

VARIABLE VENTURI TYPE CARBURETOR

BACKGROUND OF THE INVENTION

1. Field of the Invention

The present invention relates to a variable venturi type carburetor of the type having an intake passage of which cross-sectional area can be varied by negative pressure caused by suction and more particularly to a variable venturi type carburetor which functions as a conventional fixed venturi type carburetor comprising a combination of outer and inner venturis during operation under lower load or the like condition but actuates piston valve during operation under intermediate load, higher load or the like condition to vary the cross-sectional area of the intake passage and moreover can prepare the optimum mixture of fuel over the whole range of engine operation by injecting auxiliary fuel.

2. Description of the Prior Art

It is found that the conventional fixed venturi type carburetor including inner and outer venturis has such a drawback that it is difficult to properly maintain a ratio of air to fuel during operation with the throttle valve kept opened to an intermediate level of opening as well as during operation at a lower rotational speed with the throttle valve fully opened, when the cross-sectional area of the venturi section is determined to generate the maximum output with engine and engine fails to generate its maximum output when the cross-sectional area of the venturi section is intentionally reduced in consideration on the problem relative to the aforementioned ratio of air to fuel, and therefore it cannot obtain satisfactory function over the whole range of operation thereof.

To obviate the foregoing drawback there were already made a variety of proposals for variable venturi type carburetor including a piston valve for varying an effective area of intake passage and a jet needle disposed on the foremost end of the piston valve for controlling both a rate of air passing through the intake passage and a rate of supply of fuel into the latter. One of the hitherto proposed variable venturi type carburetors is intended to atomize fuel and thereby produce well vaporized mixture, as disclosed in Japanese Utility Model Publication No. 4963/1969 (Utility Model Registration No. 884,791) which was filed by the inventor. The carburetor according to his prior invention includes inner and outer venturis and a part of the outer venturi is constituted by the piston valve. The cylindrical inner venturi with a main nozzle incorporated therein is formed integral with the bottom portion of the intake passage and piston valve of which foremost end part is designed in the U-shaped configuration is disposed outside the inner venturi so as to close the outer venturi during operation at a lower speed as required. The jet needle on the foremost end of the piston valve is inserted into the main nozzle through the inner venturi.

However, it is also found that the carburetor according to the inventor's prior invention has a drawback that it is manufactured at an expensive cost because of necessity for machining the jet needle with high accuracy.

SUMMARY OF THE INVENTION

Thus, the present invention has been made with the foregoing background in mind and its object resides in providing a variable venturi type carburetor of the early mentioned type which is simple in structure, can be manufactured at an inexpensive cost and assures a proper ratio of air to fuel over the whole range of operation of engine without any necessity for conventional complicated jet needle.

It is other object of the invention to provide a variable venturi type carburetor which has reduced resitance of suction air owing to improved arrangement of both main nozzle and auxiliary fuel nozzle in the intake passage to assure good distribution of mixture gas.

It is another object of the invention to provide a variable venturi type carburetor which assures that no auxiliary fuel is injected through the auxiliary fuel nozzle when the piston valve is held in the inoperative state.

It is further another object of the invention to provide a variable venturi type carburetor which assures that the piston valve is inhibited from actuation of the piston valve when no actuation of the same is required.

It is still another object of the invention to provide a variable venturi type carburetor which assures that auxiliary fuel is easily injected through the auxiliary fuel nozzle even when a reduced volume of air is sucked at the beginning time of actuation of the piston valve.

Other objects, features and advantages of the invention will become more clearly apparent by reading of the following description which has been made with conjunction with the accompanying drawings.

BRIEF DESCRIPTION OF THE DRAWINGS

The accompanying drawings will be briefly described below.

FIGS. 2 and 3 are a fragmental sectional view of the carburetor, particularly illustrating a combination of auxiliary fuel nozzle and piston valve as seen in the direction of the intake passage, wherein FIG. 2 illustrates their arrangement under lower load and FIG. 3 does under higher load.

DESCRIPTION OF THE PREFERRED EMBODIMENTS

Figure 1:
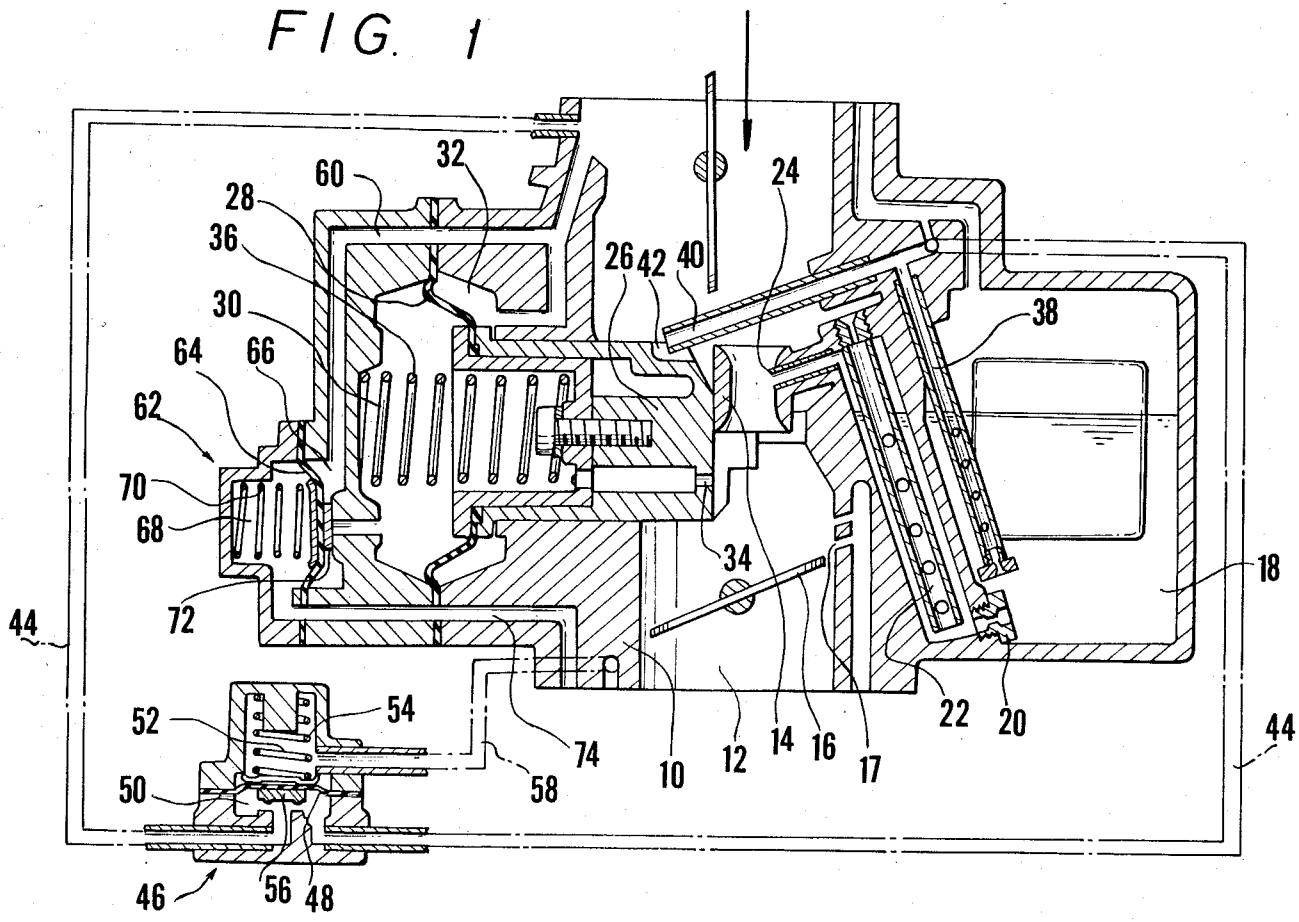
FIG. 1 is a sectional view of a variable venturi type carburetor in accordance with an embodiment of the invention.
Figure 2:
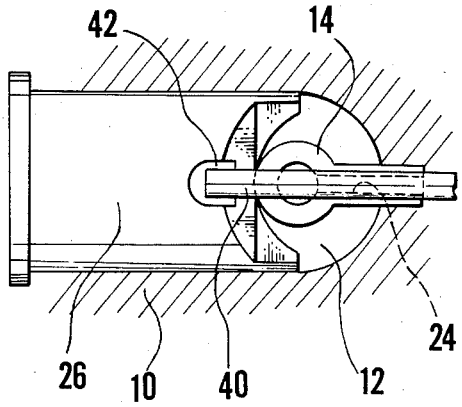
Figure 3:
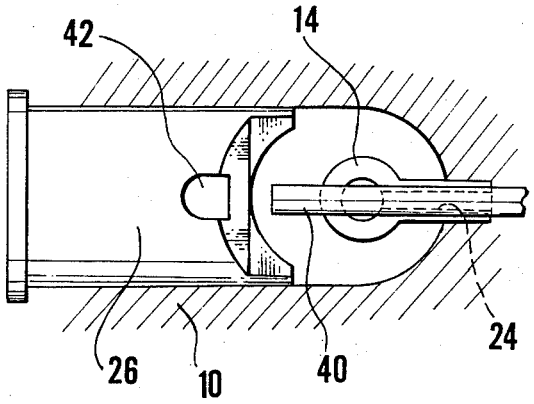

Now, the present invention will be described below with reference to the accompanying drawings which schematically illustrate preferred embodiments thereof. Among the drawings FIG. 1 is a vertical sectional view of a variable venturi type carburetor in accordance with an embodiment of the invention and FIGS. 2 and 3 are a fragmental sectional view of the carburetor particularly illustrating a combination of auxiliary fuel nozzle, main nozzle and piston valve, wherein FIG. 2 illustrates an operational arrangement of the carburetor in the lower loaded state and FIG. 3 does the same in the higher loaded state. The single barrel type carburetor includes a housing 10 in which an intake passage 12 is formed. Further, it is equipped with a inner venturi 14 and a throttle valve 16 in the intake passage 12, the throttle valve 16 being located downstream of the inner venturi 14. To feed fuel for the purpose of operation at a lower speed a bypass hole 17 is formed on the inner wall of the intake passage 12 at the position located in the vicinity of the throttle valve 16. Main fuel is injected into the inner venturi 14 via the main fuel passage 22 and the main nozzle 24. An outer venturi is constituted by a combination of the inner wall of the housing and a piston valve 26 on the outside of the inner venturi 14. The piston valve 26 has a diaphragm 28 fixedly secured to The one end thereof and the peripheral portion of the diaphragm 28 is immovably fastened to the housing 10. The hollow space located outside the piston valve 26 is divided into two chambers by means of the diaphragm 28, one of them being a negative pressure chamber 30 and the other one being an atmospheric chamber 32 which is in communication with the atmosphere. The negative pressure chamber 30 is in communication with the intake passage 12 via a communication hole 34 on the piston valve 26 at the position located downstream of the inner venturi 14. The piston valve 26 is normally biased toward the inner venturi 14 under the effect of resilient force of a coil spring 36 disposed in the negative pressure chamber 30. The piston valve 26 is formed with a groove 42 on the upstream side of the intake passage 12, the groove 42 extending by a distance in the fore end part of the piston valve 26.

Further, the carburetor includes an auxiliary fuel passage 38 in addition to the main fuel passage 22, the auxiliary fuel passage 38 extending from the float chamber 18 to be in communication with an auxiliary fuel nozzle 40. The foremost end of the auxiliary fuel nozzle 40 is located to stay in the groove 42 on the piston valve 26 while the latter is held in the inoperative state. Namely, the foremost end of the auxiliary fuel nozzle 40 is located in the outer venturi at the position upstream of the piston valve 26. Incidentally, the foremost end of the auxiliary fuel nozzle 40 is kept away from the groove 42 when the piston valve 26 is actuated under intermediate or higher load.

As seen in the direction of extension of the intake passage (FIGS. 2 and 3), the auxiliary fuel nozzle 40 is projected into the intake passage 12 from the same side where the main nozzle 24 is projected thereinto and the center axis of the former overlaps that of the latter. Further, the center axis of the auxiliary fuel nozzle 40 extends on the same plane as those of the inner venturi 14 and the piston valve 26. It should be noted that the present invention should not be limited only to the case where these center axes extend on the same plane.

As is apparent from FIG. 1, a first atmospheric passage 44 is branched from the auxiliary fuel passage 38 at the position midway of the latter and the one end of the first atmospheric passage 44 is opened at the upstream side of the intake passage. The first atmospheric passage 44 is equipped with a bleed air valve 46 adapted to open and close it.

The bleed air valve 46 is constituted mainly by a diaphragm 48, an atmospheric chamber 50 defined by the diaphragm 48, a negative pressure chamber 52 defined by the diaphragm 48, a coil spring 54 serving to normally biase the diaphragm 48 toward the atmospheric chamber 50 and a valve disc 56 attached to the diaphragm 48 in the atmospheric chamber 50. The latter forms a part of the first atmospheric passage 44. To introduce negative pressure into the negative pressure chamber 52 from manifold a first negative pressure passage 58 is connected to the negative pressure chamber 52.

When higher negative pressure is introduced into the negative pressure chamber 52 of the bleed air valve 46 from manifold during operation under lower load or the like condition, upward force due to thus introduced negative pressure as seen in the drawing overcomes resilient force of the coil spring 54 and thereby the diaphragm 48 is displaced toward the negative pressure chamber 52, resulting in the valve disc 56 being parted from the valve seat. Thus, atmospheric air is introduced into the auxiliary fuel passage 38 via the first atmospheric passage 44. On the contrary, when negative pressure decreases during operation under partial load, higher load or the like condition, resilient force of the spring 54 overcomes force on the diaphragm 48 due to negative pressure introduced into the negative pressure chamber 52 from manifold and thereby the diaphragm 48 is displaced downwardly until the valve disc 56 is caused to come in contact with the valve seat to shut the first atmospheric passage 44.

On the other hand, the negative pressure chamber 30 serving to actuate the piston valve 26 is in communication with a second atmospheric passage 60 of which one end is opened at the upstream side of the intake passage 12. The second atmospheric passage 60 is equipped with a vacuum switching valve 62 adapted to open and close it.

The vacuum switching valve 62 is constituted mainly by a diaphragm 64, an atmospheric chamber 66, a negative pressure chamber 68, both the chambers 66 and 68 being defined by the diaphragm 64, a coil spring 70 adapted to normally bias the diaphragm 64 toward the atmospheric chamber 66 and a valve disc 72 attached to the diaphragm 64 in the atmospheric chamber 66. The atmospheric chamber 66 forms a part of the second atmospheric passage 60 and to introduce negative pressure into the negative pressure chamber 68 from manifold the latter is in communication with a second negative pressure passage 74.

Since lower negative pressure is introduced into the negative pressure chamber 30 of the piston valve 26 during operation under higher load or the like condition, the piston valve 26 is biased toward the inner venturi 14 under the effect of resilient force of the spring 36 (corresponding to the operational state as illustrated in FIGS. 1 and 2). At this moment the foremost end of the auxiliary fuel nozzle 40 is located in the groove 42 on the piston valve 26 and very few air flows through the area around the foremost end of the auxiliary fuel nozzle 40 whereby no fuel is injected through the latter. Therefore, fuel is fed via the main nozzle 24 and the bypass hole 17 in the same manner as the conventional single barrel type carburetor. This means that the venturi section functions as a fixed type venturi.

As the throttle valve 16 is opened later, power due to negative pressure introduced into the negative pressure chamber 30 of the piston valve 26 becomes larger than resilient force of the spring 36 and thereby the piston valve 26 is caused to move in the leftward direction as seen in FIG. 1. Movement of the piston valve 26 made in that way varies cross-sectional area of the outer venturi. As the piston valve is actuated, fuel is injected through the auxiliary nozzle 40 in addition to fuel injected through the main nozzle 24 and the bypass hole 17 in the same manner as described above whereby a ratio of air to fuel is maintained properly.

When the carburetor is caused to operate under partial load, high load or the like condition, the foremost end of the auxiliary fuel nozzle 40 is parted away from the groove 42 on the piston valve 26, causing the auxiliary fuel nozzle 40 to stay in the substantially central part of the outer venturi. Thus, fuel is increasingly injected through the auxiliary fuel nozzle 40 under the influence of negative pressure due to air suction. During operation of the carburetor in the transitional area extending from partial load to higher load (corresponding to the operational state as illustrated in FIG. 3) auxiliary fuel is fed through the auxiliary fuel nozzle 40 in addition to fuel through the main nozzle 24. As a result a ratio of fuel mixture is controlled properly.

As will be readily understood from the above description, the carburetor of the invention is basically constructed on the base of conventional single barrel type carburetor and the present invention consists in additional arrangement of just two components, that is, a piston valve adapted to move in response to negative pressure during operation under partial load, higher load or the like condition and an auxiliary fuel system for injecting auxiliary fuel in accordance with displacement of the piston valve. Thus, characterising features of the invention are that the carburetor of the invention is simple in structure and can be manufactured at an inexpensive cost compared with the conventional carburetor.

It should be noted that an amount of poisonous component in exhaust gas can be reduced as long as a ratio of intake passage area (total area comprising area of inner venturi and area of outer venturi) at a time when the piston valve 26 is inoperative to that at a time when it is fully operative is maintained in the range of 35:100 to 65:100.

According to the invention the piston valve 26 is formed with a groove 42 so that the auxiliary fuel nozzle 40 is located in the groove 42. This causes the auxiliary nozzle 40 to assume the position where air is easy to flow. It will be noted that this position is located closer to the narrowest portion in the outer venturi, that is, the position where highest negative pressure is generated. Thus, fuel can be easily injected through the auxiliary fuel nozzle 40 compared with the case where the piston valve 26 was not formed with a groove 42, even if a reduced volume of intake air is introduced into the carburetor at a time when auxiliary fuel is required.

Figure 4:
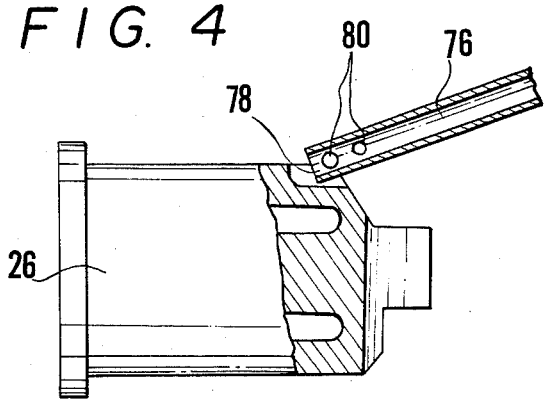
FIG. 4 is a fragmental view of a carburetor in accordance with a modified embodiment of the invention, particularly illustrating the foremost end of an auxiliary fuel nozzle.
Figure 5:
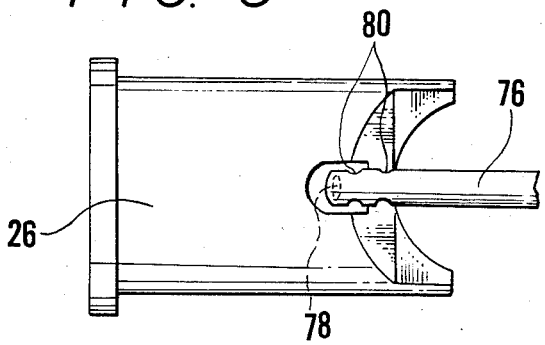
FIG. 5 is a plan view of the combination of piston valve and auxiliary fuel nozzle in FIG. 4.
Figure 6:
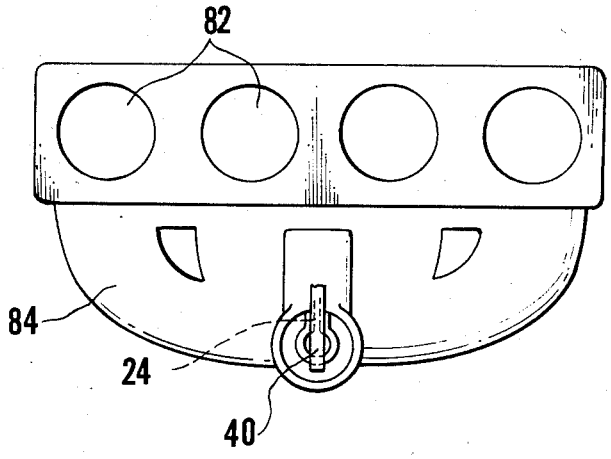
FIG. 6 is a view illustrating how the auxiliary fuel nozzle and the main nozzle are arranged relative to engine cylinders.

As a modification from the foregoing embodiment, the auxiliary fuel nozzle 76 may be formed with a plurality of injection ports 80 in addition to the injection port 78 at the foremost end thereof, the injection ports 80 being located in the proximity of the foremost end of the auxiliary fuel nozzle 76, as illustrated in FIGS. 4 and 5. The injection port 78 may be closed where a plurality of injection ports 80 is formed on the auxiliary fuel nozzle 76. Owing to the additional arrangement of the plural fuel injection ports 80 on the auxiliary fuel nozzle 76 it is possible to more precisely control a rate of injection of auxiliary fuel.

In this modified embodiment it is possible to more precisely control a rate of injection of auxiliary fuel by determining the size of each of the fuel injection ports 80 in such a manner that it increases toward the foremost end of the auxiliary fuel nozzle 76.

Incidentally, some of the injection ports 80 on the auxiliary fuel nozzle 76 may be located outwardly of the groove 42 of the piston valve 26 when the piston valve 26 is held in the inoperative state. This arrangement inhibits an occurrence of feeding of auxiliary fuel with delay.

According to the invention the center axis of the auxiliary fuel nozzle 40 and that of the main nozzle 24 are located on the same plane extending in the direction of the intake passage 12 and moreover they are located adjacent to one another. Protrusion of two nozzles into the intake passage 12 does not cause increased air resistance in the intake passage 12. Thus, fuel mixture can be distributed properly.

Further, the direction of extension of the center axes of the auxiliary fuel nozzle 40 and the main nozzle 24 may be determined at a right angle relative to the direction of arrangement of a plurality of cylinders 82. This causes fuel to be introduced into the central position of the manifold 84 and thereby fuel mixture can be distributed to each of the cylinders 82 more satisfactorily.

Another advantageous feature of the invention is that unnecessary injection of auxiliary fuel can be inhibited by introducing atmospheric air into the auxiliary fuel passage 38 with the aid of the bleed air valve 46, when no auxiliary fuel is required.

Specifically, the bleed air valve 46 is constructed such that during operation at higher manifold negative pressure under lower load or the like condition the valve disc 56 is displaced away from the valve seat under the influence of negative pressure transmitted to the negative pressure chamber 52 and thereby atmospheric air is introduced into the auxiliary fuel passage 38 via the first atmospheric passage 44. Once atmospheric air is introduced into the auxiliary fuel passage 38, no fuel is injected through the auxiliary fuel nozzle 40. Thus, unnecessary injection of auxiliary fuel can be inhibited when the piston valve is inoperative.

When negative pressure introduced into the negative pressure chamber 52 from manifold decreases later due to operation under partial load, higher load or the like condition, the first atmospheric passage 44 is caused to close. Thus, flowing of atmospheric air into the auxiliary fuel passage 38 is interrupted and thereby auxiliary fuel can be injected through the auxiliary fuel nozzle 40 in the regular way in response to actuation of the piston valve 26.

Further another advantageous feature of the invention is that actuation of the piston valve can be inhibited by introducing atmospheric air into the negative pressure chamber 30 of the piston valve 26 with the aid of the vacuum switching valve 62 when no actuation of the piston valve is required.

Specifically, the vacuum switching valve 62 is constructed such that during operation at higher manifold negative pressure under lower load or the like condition the valve disc 72 is displaced away from the valve seat under the influence of negative pressure transmitted to the negative pressure chamber 68 and thereby atmospheric air is introduced into the negative pressure chamber 30 of the piston valve 26 via the second atmospheric passage 60 to reduce negative pressure in the negative pressure chamber 30. Thus, unnecessary actuation of the piston valve 26 can be inhibited without fail when no actuation of the piston valve 26 is required during operation under lower load or the like condition.

When negative pressure transmitted to the negative pressure chamber 68 from manifold decreases later due to transference to partial load, higher load or the like condition, the second atmospheric passage 60 is caused to close. Thus, introduction of atmospheric air into the negative pressure chamber 30 of the piston valve 26 is interrupted and thereby the piston valve 26 is actuated in the regular way merely under the influence of negative pressure transmitted via the communication hole 34.

While the present invention has been described above with respect to preferred embodiments thereof, it should of course be understood that it should not be limited only to them but various changes or modifications may be made in any acceptable manner without departure from the spirit and scope of the invention as defined by the appended claims.

What is claimed is:

1. A variable venturi type carburetor essentially comprising;

an inner venturi disposed in the intake passage, an outer venturi wall formed by the intake passage, a main nozzle adapted to inject main fuel into the inner venturi, a piston valve disposed as a part of the outer venturi wall, said piston valve being displaced under the influence of negative pressure in the intake passage, and an auxiliary fuel nozzle disposed on the outer venturi to feed auxiliary fuel to the outer venturi in response to displacement of the piston valve.

2. A variable venturi type carburetor as defined in claim 1, wherein the center axis of the auxiliary fuel nozzle and that of the main nozzle are located on the substantially same plane extending in the direction of the intake passage.

3. A variable venturi type carburetor as defined in claim 2, wherein the center axis of the auxiliary fuel nozzle and that of the main nozzle are located in the direction at a right angle relative to the direction of arrangement of a plurality of engine cylinders.

4. A variable venturi type carburetor as defined in claim 1, wherein an atmospheric pressure introduction passage of which one end is opened to the atmosphere is branched from the midway of the auxiliary fuel passage leading to the auxiliary fuel nozzle and a bleed air valve disposed midway of the atmospheric pressure introduction passage to open the latter when higher negative pressure is transmitted from manifold.

5. A variable venturi type carburetor as defined in claim 4, wherein said bleed air valve comprises a diaphragm, an atmospheric chamber defined by said diaphragm constituting a part of the atmospheric pressure introduction passage, a negative pressure chamber defined by said diaphragm into which negative pressure is normally transmitted from manifold, spring means adapted to normally bias the diaphragm toward the atmospheric chamber and a valve body attached to the diaphragm in the atmospheric chamber to open and close the atmospheric pressure introduction passage.

6. A variable venturi type carburetor as defined in claim 1, wherein a negative pressure chamber for actuating the piston valve is in communication with an atmospheric pressure introduction passage of which one end is opened to the atmosphere and a vacuum switching valve is disposed midway of said atmospheric pressure introduction passage to open the latter when higher negative pressure is transmitted from manifold.

7. A variable venturi type carburetor as defined in claim 6, wherein said vacuum switching valve comprises a diaphragm, an atmospheric chamber defined by said diaphragm constituting a part of the atmospheric pressure introduction passage, a negative pressure chamber defined by said diaphragm into which negative pressure is normally transmitted from manifold, spring means adapted to normally bias the diaphragm toward the atmospheric chamber and a valve disc attached to the diaphragm in the atmospheric chamber to open and close the atmospheric pressure introduction passage.

8. A variable venturi type carburetor as defined in claim 1, wherein the piston valve is formed with a groove at the position located on the upstream side of the intake passage, said groove extending by a distance on the fore part of the piston valve, so that the foremost end of the auxiliary fuel nozzle is located in the groove when the piston valve is held in the inoperative state.

9. A variable venturi type carburetor as defined in claim 8, wherein the auxiliary fuel nozzle is formed with a plurality of fuel injection ports at the position located in the vicinity of the foremost end thereof.

10. A variable venturi type carburetor as defined in claim 9, wherein the size of said plural fuel injection ports is determined in such a manner that it increases stepwise toward the fuel injection port on the foremost end of the auxiliary fuel nozzle.

11. A variable venturi type carburetor as defined in any one of claims 1 to 10, wherein a ratio of total cross-sectional area of the venturi section in the intake passage at a time when the piston valve is operative to that at a time when it is inoperative is determined in the range of 35:100 to 65:100.

* * * * *